United States Patent [19]

Asaga

[11] 3,945,359

[45] Mar. 23, 1976

[54] ROTOR ENGINE

[76] Inventor: Ryuzi Asaga, 1-10, No. 579, Fukuzumi Oshibedani-cho, Tarumi, Kobe, Japan

[22] Filed: Nov. 27, 1973

[21] Appl. No.: 419,340

[52] U.S. Cl. ..... 123/58 R; 123/80 BB; 123/190 BA

[51] Int. Cl.[2] ..... F02B 75/26

[58] Field of Search ..... 123/58 R, 80 BB, 190 BA, 123/192

[56] References Cited

UNITED STATES PATENTS

| | | | |
|---|---|---|---|
| 1,096,952 | 5/1914 | Robb et al. | 123/190 BA |
| 1,298,132 | 3/1919 | Williams | 123/75 B |
| 2,065,790 | 12/1936 | Braunwalder | 123/58 R |
| 2,403,282 | 7/1946 | Holmes | 123/190 BA |

*Primary Examiner*—C. J. Husar
*Assistant Examiner*—O. T. Sessions
*Attorney, Agent, or Firm*—Otto John Munz

[57] ABSTRACT

A rotary internal combustion engine which includes a plurality of cylinders equiangularly mounted around a central rotary valve assembly on an axial horizontal shaft, in which more complete combustion and less emission of unburnt gases is achieved. The engine embodies a valving rotor comprising horizontally spaced discs having two properly located intake and exhaust valve passages and related generally cup-shaped intake/exhaust guide means eccentrically mounted on the shaft. This arrangement together with correspondingly horizontally spaced intake/exhaust ports in the respective cylinders, provides for dual intake charges and for the exhaust gas to be discharged twice and more completely in a single exhaust stroke via the properly located exhaust valves. The exhaust valves, which are also in the horizontally spaced rotor discs, are circumferentially displaced from the respective intake valves and also from each other.

6 Claims, 8 Drawing Figures

FIG. 1
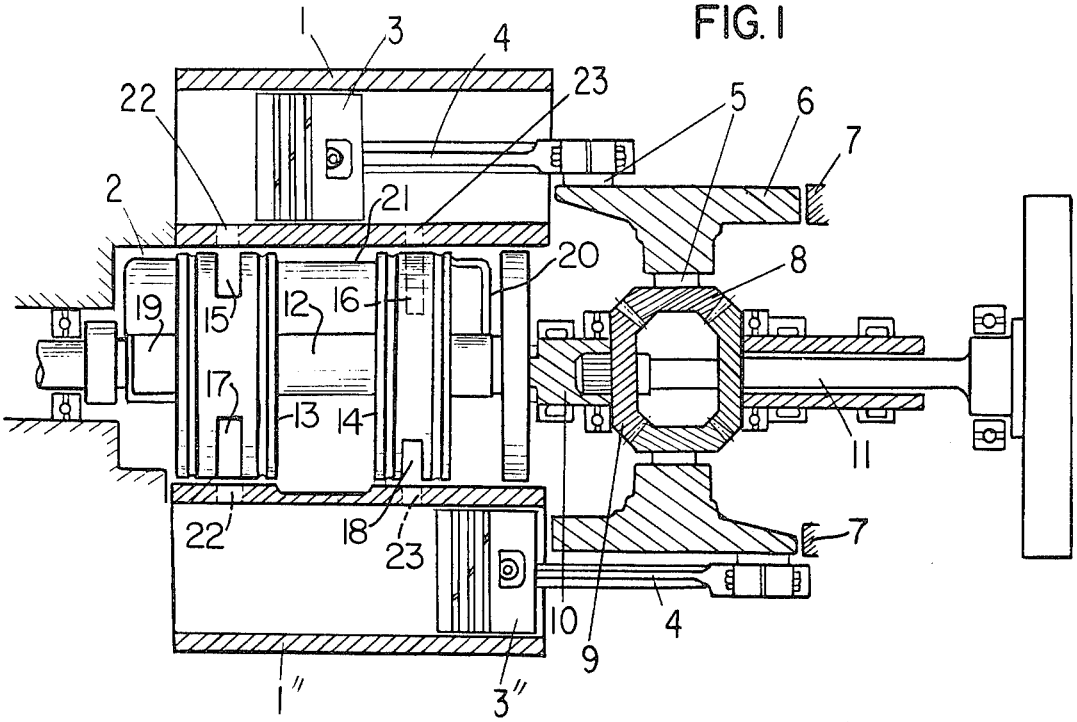
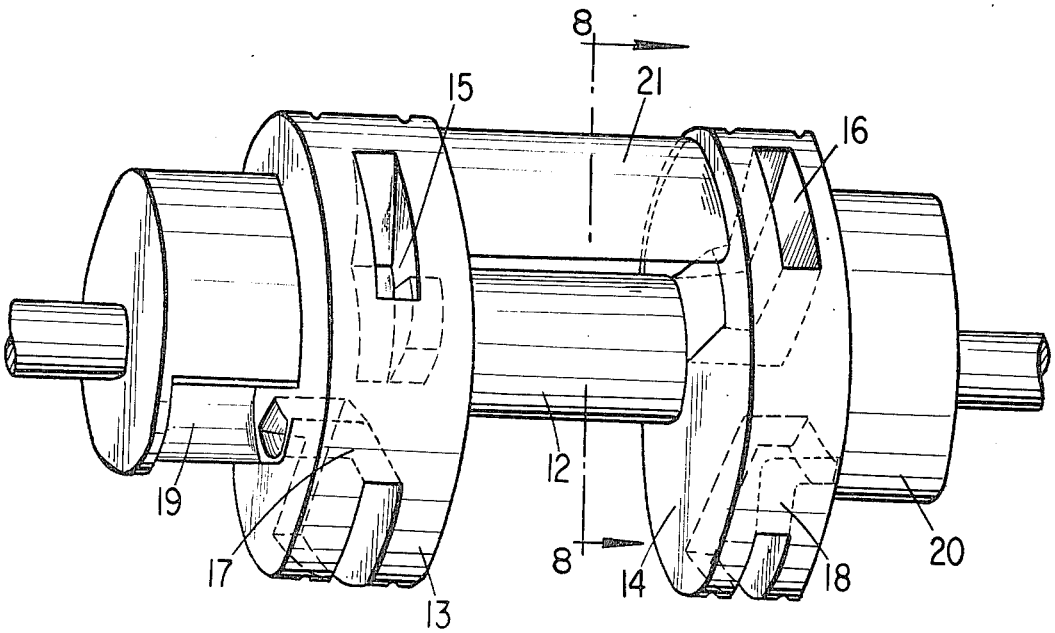
FIG. 2

FIG.5
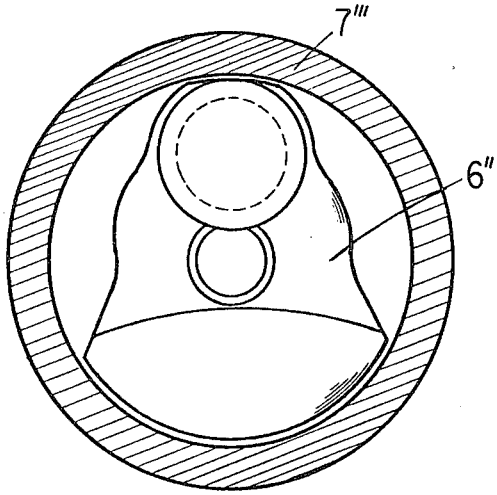
FIG.8
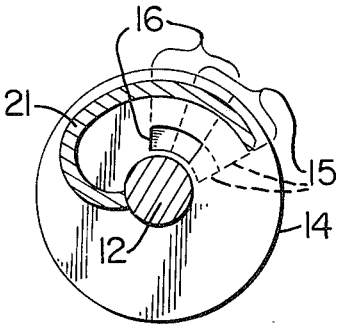
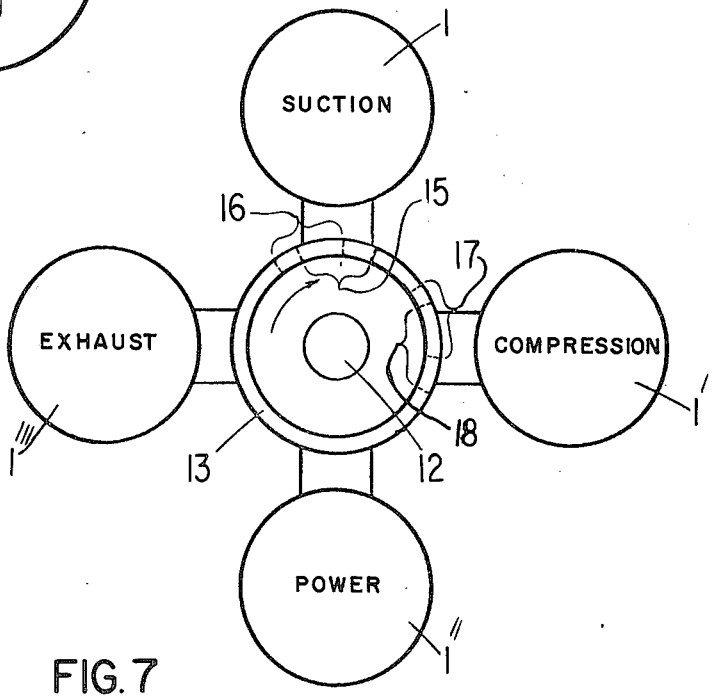
FIG.7

ROTOR ENGINE

BACKGROUND OF THE INVENTION

The present invention relates to a rotor engine of the type in which a plurality of cylinders are equiangularly mounted around a chamber of a rotor assembly in parallel with the axis thereof in such a manner that the rotation of a crank shaft of each cylinder may be transmitted to the rotor assembly provided with intake and exhaust ports and intake and exhaust gas guide members, whereby the intake and exhaust of the cylinders may be effected through the rotor assembly as the latter is rotated.

The valve operating mechanisms of the conventional piston engines are very complex so that when the engines are driven at a high speed, the abrasion and wear of the intake and exhaust valves and their valve seats are very fast. The parts of the valve operating mechanisms such as cam shafts, springs, silent chains, timing gears and so on are fabricated with a higher degree of accuracy because the accuracy will affect the valve timing. Therefore the abrasion and wear of these parts also adversely affect the valve timing.

In view of the above one of the objects of the present invention is to provide a novel rotary valve type engine which may eliminate intake and exhaust valves and a valve operating mechanism, ensure the complete combustion with the result of the reduction in emission of pollutants, and improve the output efficiency.

BRIEF DESCRIPTION OF THE DRAWINGS

FIG. 1 is a longitudinal sectional view of one preferred embodiment of the present invention;

FIG. 2 is a perspective view taken through the rotor and piston cylinders of a rotor assembly thereof;

FIG. 5 is a front view, partly in cross section, of a balance weight and a balance weight bearing as viewed on line 5—5 of FIG. 4;

FIG. 7 is a diagrammatic view used for the explanation of the relation of suction, compression, power and exhaust strokes of the cylinders with respect to the rotation of the rotor assembly;

FIG. 8 is a cross-sectional detail view taken on line 8—8 of FIG. 2.

DESCRIPTION OF THE PREFERRED EMBODIMENTS

Figure 3:
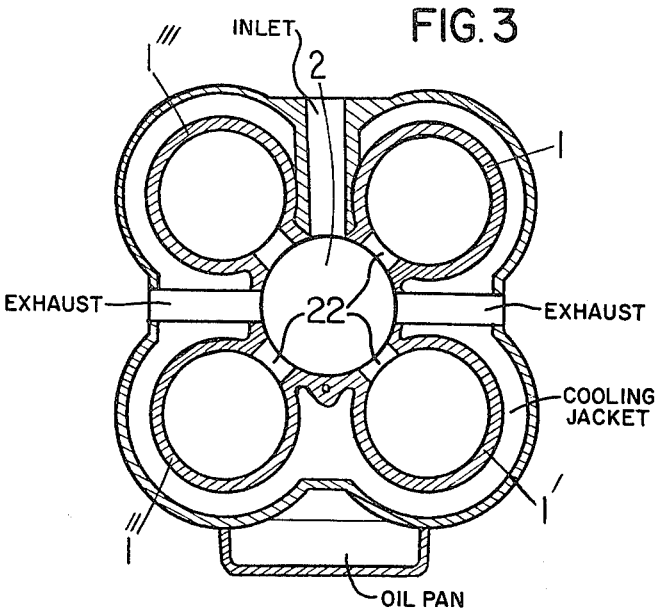
FIG. 3 is a cross sectional view of the rotor engine shown in FIG. 1.
Figure 4:
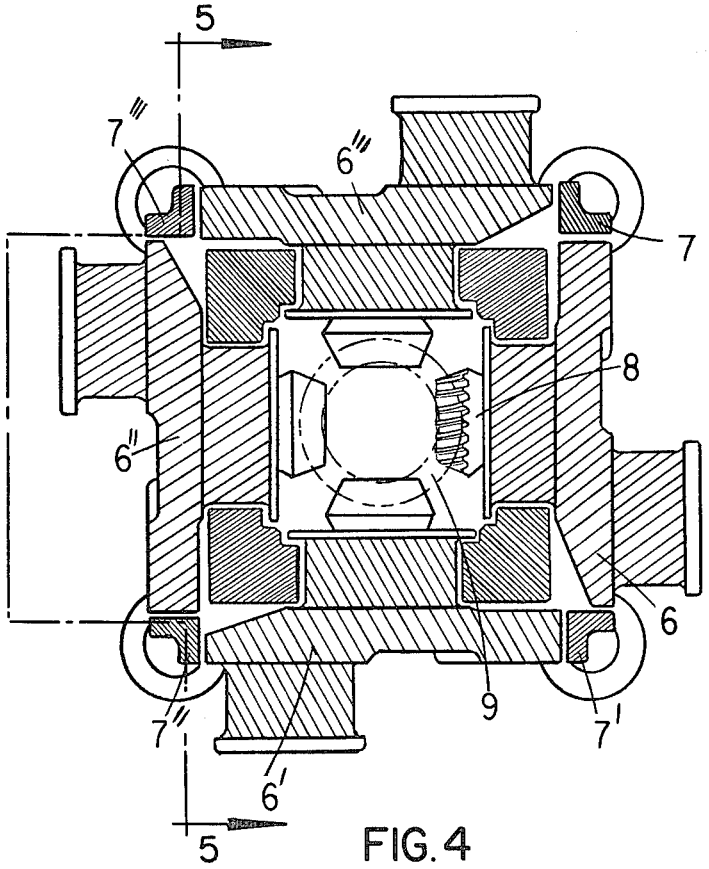
FIG. 4 is a cross sectional view of a bevel gear assembly thereof.

Four cylinders 1, 1', 1'', and 1''' are equiangularly mounted around a rotor chamber 2 in parallel therewith as best shown in FIG. 3. Each of the cylinders have communication with the rotor chamber 2 through intake-exhaust ports 22 and 23 as will be described in more detail hereinafter. As shown in FIG. 1, pistons 3,3', 3'' and 3''' are drivingly connected through connecting rods 4,4', 4'' and 4''' and crank shafts 5,5',5'' and 5''' to counter balance weights 6,6',6'' and 6''', respectively. which are rotatably received in annular balance weight bearings 7,7',7'' and 7''' as best shown in FIGS. 4 and 5. The balance weights 6,6',6'', and 6''' are keyed to shafts driving bevel gears 8,8',8'', and 8''', respectively, as best shown in FIG. 4, which are in mesh with driven bevel gears 9 and 9'keyed or splined to a rotor shaft 10 and an output shaft 11, as shown in FIG. 1. The rotor shaft 10 is drivingly coupled to a shaft 12 shown in FIG. 1 which carries a pair of front (left in the figures) and rear (right in the figures) rotors 13 and 14 respectively as shown in FIG. 2. The front and rear rotors 13 and 14 are provided with intake ports 15 and 16 which open at the side walls and inner end surfaces of the front and rear rotors 13 and 14 as best shown in FIG. 2. The intake ports 15 and 16 are angularly spaced apart from each other as best shown by overlapping brackets in FIG. 7. The front and rear rotors 13 and 14 are also provided with exhaust ports 17 and 18, respectively, which open at the side walls and outer end surfaces of the rotors 13 and 14 and are angularly spaced apart from each other and from the intake ports 15 and 16 by approximately 45°, respectively, as shown in FIGS. 2 and 7. Cup-shaped exhaust gas guide members 19 and 20 are eccentrically mounted on the shaft 12 in intimate contact with the outer end surfaces of the front and rear rotors 13 and 14, respectively, so that the outside openings of the exhaust ports are opened into the cupshaped exhaust gas members 19 and 20 as shown in FIGS. 1 and 2. Between the inner end surfaces of the front and rear rotors 13 and 14 are interposed a semicylinderlike intake guide member 21 as best shown in FIG. 2 so as to facilitate the intake of air-fuel mixture through the intake ports 15 and 16.

Figure 6:
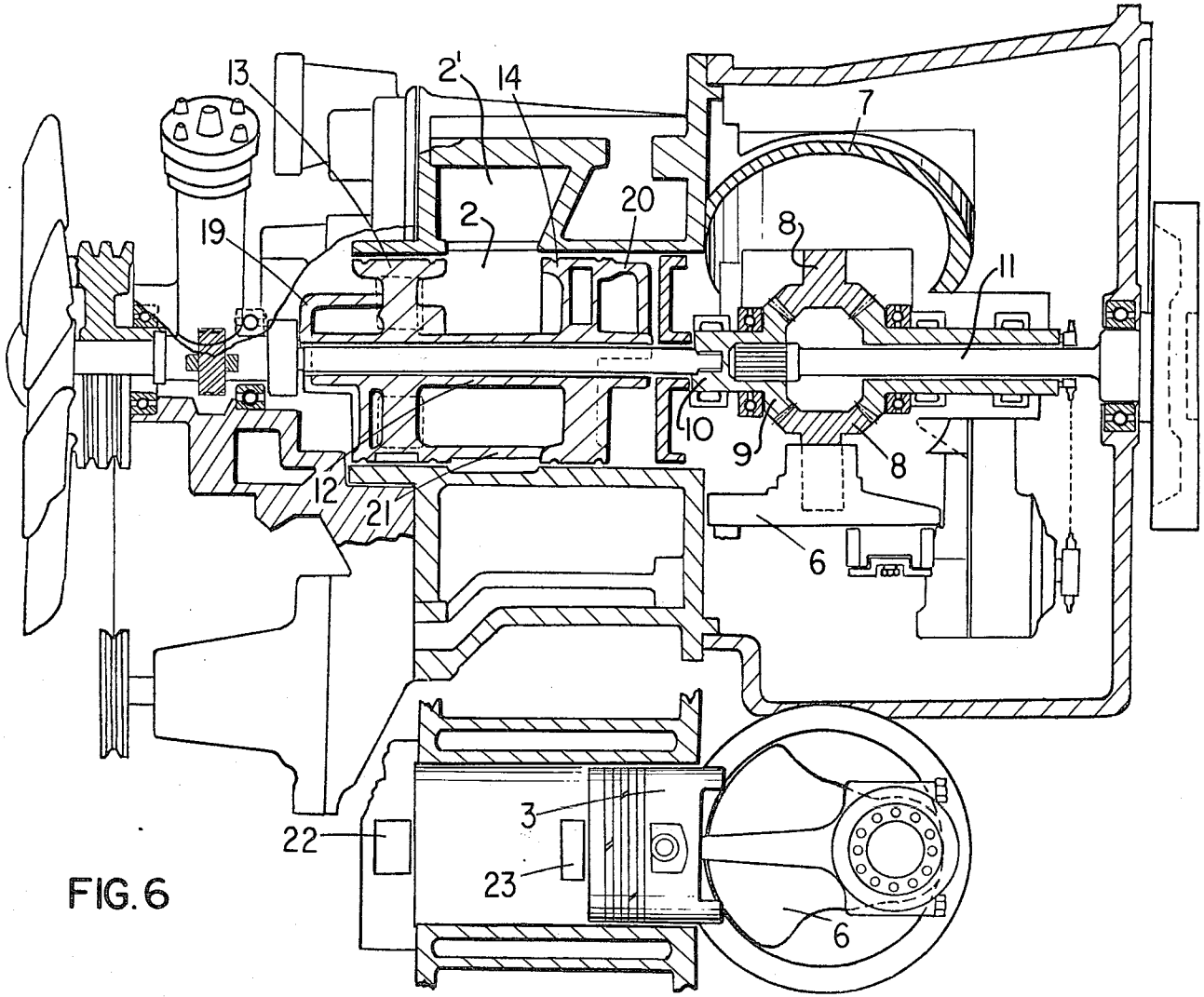
FIG. 6 is a view, partly broken away, of the rotor engine of the present invention assembled.

Next the mode of operation will be described. Air-fuel mixture from a carburetor (not shown) may enter via intake passage 2' (FIG. 6) and is charged into the space between the front and rear rotors 13 and 14 of the rotor chamber 2 and is compressed by the intake guide member 21 as the rotor assembly is rotated when a starting motor (not shown) is driven. The air-fuel mixture is forced into the intake ports 15 and 16 and injected into the cylinder 1 when the intake ports 15 and 16 coincide with the intake-exhaust ports 22 and 23, respectively, of the cylinder 1, as shown in FIG. 1. That is, the air-fuel mixture is injected into the cylinder 1 through the first intake-exhaust port 22 and then through the other axially spaced intake-exhaust port 23 as the piston 3 travels.

As the rotor assembly rotates, the intake ports 15 and 16 are relatively moved away from the intake-exhaust ports 22 and 23 toward the next cylinder so that the intake-exhaust ports 22 and 23 are closed by the side walls of the rotors 13 and 14. Then the compression stroke of the cylinder 1 is started.

As the rotor assembly rotates in the clockwise direction indicated by the arrow to the position shown in FIG. 7 the cylinder 1 is in the suction stroke, the cylinder 1' is in the compression stroke; the cylinder 1'' is in the power stroke, and the cylinder 1''' is in the exhaust stroke. Thus as the rotor assembly rotates the suction, compression, power and exhaust strokes are cycled in each cylinder.

The exhaust gas is discharged twice through the exhaust ports 17 and 18 when the piston is in the proximity of the respective top and bottom dead center, and is completely burnt as it is subjected to the centrifugal force to swirl in the rotary chamber 2. Thereafter the exhaust gas is discharged out of the engine.

The balance weight is rotatably received by the annular bearing so that the smooth rotation of the bevel gears may be ensured.

By means of the present invention, the intake and exhaust valves of the more conventional piston engines may be eliminated so that the valve clearance adjustment may be eliminated. The breakdowns of the cam shafts and other mechanisms associated with the valves may be eliminated. Furthermore the air-fuel mixture is injected twice in a single suction stroke and the exhaust gas is discharged twice in a single exhaust stroke when the piston is in the proximity of the respective top and bottom dead centers whereby the angle between the positions at which the intake valve is opened and closed respectively may be reduced. As a result the compression ratio may be increased. Furthermore the output efficiency may be remarkably increased because of the complete intake and exhaust. The exhaust gas may be completely burnt so that the emission of pollutants may be considerably reduced. The rotary valve engine of the present invention is simple in assembly, thus resulting in the improvement of the productivity.

What is claimed is:

1. In a reciprocating piston, expansible chamber internal combustion rotary valve type engine embodying a plurality of pistons disposed in corresponding piston chambers or cylinders closed at one end by cylinder head means provided with ignition means therein; with said piston chambers radially grouped around and in parallel with a centrally disposed rotor chamber within which a rotary valve is disposed with axially spaced inlet and outlet passages communicatable with said piston chambers; and with air/fuel inlet passage means leading to and combustion gas exhaust passage means leading from the rotary valve, the improvement wherein a. said piston cylinders each have a pair of axially spaced dual-acting intake and exhaust ports in a side wall portion thereof;

b. said rotary valve comprises an axial rotor shaft having an axially spaced pair of rotor discs affixed thereon, each of said rotor discs having axially oppositely facing intake and exhaust ports and corresponding intake and exhaust gas guiding passages opening radially in outer peripheries thereof; said outer peripheral passage openings disposed and adapted for predetermined rotative alignment sequentially with said cylinder intake and exhaust ports to provide fluid communication between said cylinders and rotor chamber and rotary valve therein;

c. said exhaust ports being in axially opposite end faces of said rotor discs and having adjacent eccentrically mounted exhaust guides affixed on said axial rotor shaft and to said respective rotor discs;

d. an intake guide member interposed between and interconnecting said rotor discs in overlaying relation to said intake ports which are disposed in generally axially opposed facing relation on said rotor discs;

e. motion translating means for translating the inherent reciprocal motion of said pistons into rotative motion of balance weight means which weight means comprises a balance weight connected with each piston, each balance weight being rotatably mounted within an annular bearing means; said motion translating means including a connecting rod and crank shaft operatively interconnecting each of said pistons and balance weights; and f. bevel gear means operatively interconnecting said balance weights and rotary valve shaft at one side thereof whereby said relative motion of said balance weights is transmitted by said bevel gear means to effect rotation of said rotor shaft;

g. output shaft means operatively connected to said bevel gear means and projecting from an opposite side thereof; and h. whereby an intake and exhaust of said plurality of cylinders is effected through said rotary valve as the latter is rotated in operation of the engine.

2. The engine as defined in claim 1, wherein the number of cylinders is four.

3. The engine as defined in claim 1, wherein said axially spaced rotor discs constitute front and rear rotors; said exhaust guide members are of generally cup-shape and mounted on said rotor shaft with edge portions disposed in contact with axially opposite outer end surfaces of said front and rear rotors; said intake ports and said exhaust ports being circumferentially staggered relative to each other so that the respective radial intake and exhaust ports of said front rotor are closer together than those of said rear rotor, and are collectively circumferentially offset relative to those of said rear rotor.

4. The engine as defined in claim 1, wherein said intake guide member is of generally semi-cylindrical shell form and so disposed relative to said intake ports and rotor shaft to facilitate intake of predetermined air-fuel mixtures.

5. The engine as defined in claim 1, wherein said ported rotor discs and said pistons are relatively disposed so that exhaust gas is discharged twice sequentially from said exhaust ports in a single exhaust stroke of each piston.

6. The engine of claim 1, wherein said ported rotor discs, said cylinders and said pistons are relatively disposed so that air-fuel mixture is injected sequentially twice into said piston cylinders during each suction or intake stroke of said pistons.

* * * * *